United States Patent [19]

Honders et al.

[11] Patent Number: 4,874,482

[45] Date of Patent: Oct. 17, 1989

[54] PROCESS FOR THE ELECTROYTIC PRODUCTION OF NON-METALS

[75] Inventors: Anthonie Honders; Alfred J. Horstik; Gerbrand J. M. Van Eyden, all of Arnhem, Netherlands

[73] Assignee: Shell Internationale Research Maatschappij B.V., The Hague, Netherlands

[21] Appl. No.: 167,752

[22] Filed: Mar. 15, 1988

[30] Foreign Application Priority Data

Apr. 1, 1987 [GB] United Kingdom ..... 8707780

[51] Int. Cl.[4] ..... C25B 1/00

[52] U.S. Cl. ..... 204/60; 204/61

[58] Field of Search ..... 204/61, 64 R, 60

[56] References Cited

U.S. PATENT DOCUMENTS

| | | | |
|---|---|---|---|
| 2,757,135 | 7/1956 | Gleave et al. | 204/71 |
| 2,861,030 | 11/1958 | Slatin | 204/64 |
| 3,087,873 | 4/1963 | Slatin | 204/71 |
| 4,637,864 | 1/1987 | Covino et al. | 204/61 |

FOREIGN PATENT DOCUMENTS

| | | |
|---|---|---|
| 0039873 | 11/1981 | European Pat. Off. . |
| 660908 | 11/1951 | United Kingdom . |

*Primary Examiner*—John F. Niebling
*Assistant Examiner*—David G. Ryser
*Attorney, Agent, or Firm*—Jones, Tullar & Cooper

[57] ABSTRACT

A process for the production of non-metallic element Nm or a mixture/compound containing Nm from a non-metal halide $NmX_n$ or a coplex halide $A_mNmX_o$ by electrolysis in a cell comprising an anode, a liquid metal cathode comprising one or more metals M and a liquid electrolyte comprising a salt melt of one or more alkali metal or alkaline earth metal halides, which comprises introducing non-metallic halide $NmX_n$ or complex halide $A_mMnX_o$, in which Nm represents a non-metallic element selected from the groups 3*a*, 4*a*, 5*a* and 6*a* of the periodic system, X represents halogen, n represents the valency of Nm, A represents an alkali metal and o represents the valency of Nm minus m, into the liquid metal cathode, and isolating Nm or a mixture/compound containing Nm from the metal cathode material.

22 Claims, 1 Drawing Sheet

PROCESS FOR THE ELECTROYTIC PRODUCTION OF NON-METALS

CROSS REFERENCE TO RELATED APPLICATIONS

This application discloses subject matter in common with applications Ser. Nos. 167,751 and 167,753, both filed on Mar. 15, 1988.

Technical Field

The invention relates to a process for the production of non-metallic elements or mixtures/compounds thereof by electrolysis of non-metal halides or complex halides in a cell comprising an anode, a liquid metal cathode and a liquid electrolyte.

BACKGROUND OF THE INVENTION

Winning elements, especially metals, by electrolysis in the presence of molten salts is an area in which increasing research is being carried out. An embodiment of this process is known from U.S. Pat. No. 2,757,135. In this event a halide of an element, titanium tetrachloride, is supplied to the electrolysis cell by introduction into the salt melt. In practice, that process has to be carried out with a diaphragm that prevents the flow of titanium in lower valencies to the anode. If this were not done, the titanium would be re-oxidized at the anode to tetravalent titanium and would thus give rise to a loss of current and raw material. Furthermore, the build-up of titanium in the diaphragm shortens its life, which is a significant disadvantage.

SUMMARY OF THE INVENTION

It has been found, now, that halides or complex halides of certain non-metallic elements can be used for the electrolytical production of the elements themselves or mixtures/compounds containing the non-metallic element, by introducing the halides or complex halides into a liquid metal cathode.

The present invention therefore proposes a process for the production of non-metallic element Nm or a mixture/compound containing Nm from a non-metal halide $NmX_n$ or a complex halide $A_mNmX_o$ by electrolysis in a cell comprising an anode, a liquid metal cathode comprising one or more metals M and a liquid electrolyte comprising a salt melt of one or more alkali metal or alkaline earth metal halides, which comprises introducing non-metallic halide $NmX_n$ or complex halide $A_mNmX_o$, in which Nm represents a non-metallic element selected from the groups 3a, 4a, 5a and 6a of the periodic system, X represents halogen, n represents the valency of Nm, A represents an alkali metal and o represents the valency of Nm minus m, into the liquid metal cathode, and isolating Nm or a mixture/compound containing Nm from the metal cathode material.

BRIEF DESCRIPTION OF THE DRAWINGS

The invention will be discussed in more detail with reference to FIGS. 1 and 2, which illustrate possible electrolytic cells, taking the electrolysis of silicium tetrachloride to produce silicium in a liquid zinc cathode as example.

DETAILED DESCRIPTION OF THE PREFERRED EMBODIMENTS

Figure 1:
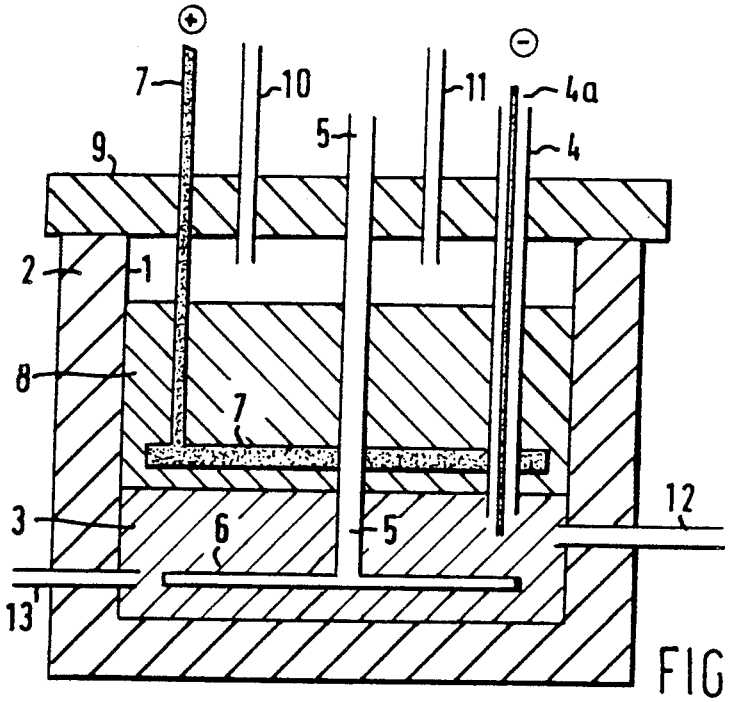
FIG. 1 is a cross-sectional view of an electrolytic cell in accordance with one embodiment of the invention.

In FIG. 1 cell 1 is in a jacket of thermally insulating material 2, for example refractory brick. Cathode 3 consists of liquid zinc to which current is fed via insulating pipe 4 and feed rod 4a. Supply of silicium tetrachloride takes place via pipe 5 and distributor 6, for example a metal grid with outlets at intervals or a body of porous ceramic material. Anode 7 is positioned in electrolyte 8 near the interface between cathode and electrolyte. The horizontal surface area of the anode is chosen to be as large as possible. Electrolyte 8, for example a lithium chloride/potassium chloride melt, is heated to a high temperature, for example 350° to 900° C. or higher if operations are carried out under pressure. Through lid 9 runs a supply pipe 10 for inert gas, for example argon, and a discharge pipe 11 for chlorine gas which is generated at the anode. The current and the supply of silicium tetrachloride are adjusted to match each other such that all or substantially all silicium is reduced in the cathode, thus forming a zinc/silicium mixture. This means that the anode does not need to be shielded by a diaphragm. This can be achieved with, for example a current of at least 4 Faraday per mol silicium tetrachloride. Vaporization of silicium tetrachloride before its introduction into the cathode is not necessary, since its temperature rises in any case to above its boiling point (57° C.) during its passage through the salt melt. If desired, the cell can also be provided with means for temperature control of the process. The space above electrolyte 8 can also be cooled or any vaporized salt melt of zinc can be internally or externally condensed and fed back. Supply and discharge of cathode liquid takes place via lines 12 and 13, in particular in the continuous embodiment. The silicon content in the Zn/Si mixture will be allowed to increase to a predetermined value. Recovery of silicium from the mixture may be carried out by conventional methods, e.g. by distilling off cathode metal or non-metal Nm.

Figure 2:
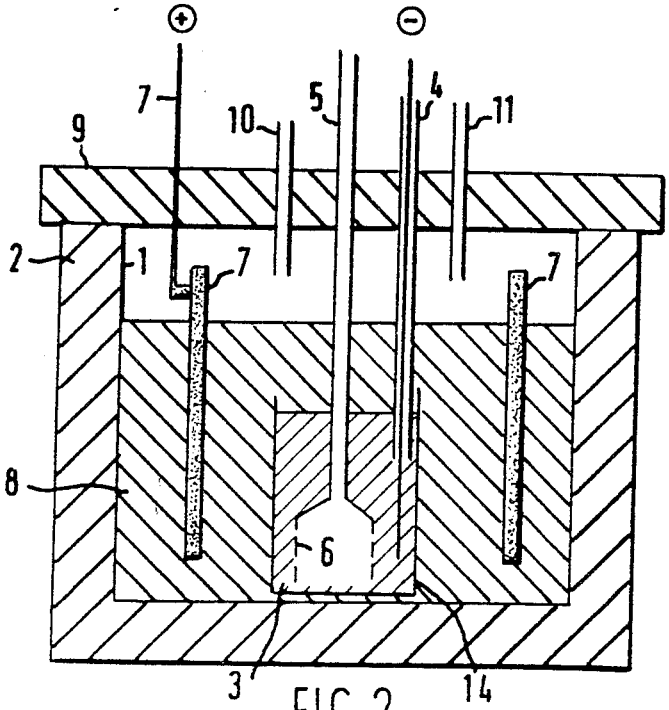
FIG. 2 is a cross-sectional view of an electrolytic cell in accordance with another embodiment of the invention.

FIG. 2 shows a cell with a vertically positioned anode. The same reference numerals have been retained for the same elements of the construction. In the salt melt a tray 14 is placed in which liquid zinc is present. Silicium tetrachloride vapour now enters via perforations in the lower part of supply pipe 5. Anode 7 is constructed as a closed cylinder which completely surrounds the cathode.

Although in the preceding section the process of this invention has been described by reference to a preferred embodiment, i.e. production of silicium from silicium tetrachloride employing a liquid zinc cathode, the invention is not limited thereto. Analogous processing can be carried out with different cathode materials, i.e. cadmium, aluminium, tin, lead, indium, bismuth and gallium. Zinc, tin and lead are preferred. Likewise other feedstocks may be processed, e.g. halides of boron, carbon, germanium, arsenic, tellurium, phosphorus and antimony, or complex halides of these elements as $Na_2SiF_6$, $K_2SiF_6$, $NaBF_4$, $NaSbF_6$, $Na_2AsF_6$, $Na_2GeF_6$ and $K_2GeF_6$. Preferred alkali metals A in the complex halides are lithium, sodium or potassium. Preferred non-metallic elements Nm are elements from groups 4a or 5a of the periodic table. Preferred halides to be processed are those of germanium, silicium and antimony. The preferred halogen atom is chlorine or fluorine (when complex halides are used), as it is for the molten salt compositions.

It is not known to what extent the production of Nm proceeds via direct electrolytic conversion. Introduction of the halide into a liquid metal cathode at elevated temperature may result in a chemical reduction of non-metal Nm to lower valencies, this may then be followed by electrolytic reduction of lower valent non-metal to the (zerovalent) non-metal, coupled with electrolytic regeneration (reduction) of cathode material. Such combined chemical and electrolytic reductions of Nm in a higher valency to zerovalent non-metal Nm are included expressis verbis in the scope of this invention. What is essential to this invention is the application of an electrolytic cell with a liquid metal or alloy cathode, an introduction of halide $NmX_n$ or complex halide $A_mNmX_o$ directly into the liquid cathode and production of (zerovalent) Nm within the cathode material, the latter as distinguished from production of Nm somewhere else, i.e. in the molten salt electrolyte or by deposition on a second or auxiliary cathode. Absence of a diaphragm is also important.

The salt melts may be free from impurities but this is not strictly necessary, while in addition it may be advantageous to work under an inert atmosphere of, for example, argon or nitrogen. Examples of suitable salt melts are LiCl/NaCl, NaCl/KCl, LiCl/KCl, LiCl/$CaCl_2$, NaCl/$BaCl_2$ and KCl/$CaCl_2$, but, as has already been pointed out, the invention is not limited to the above-mentioned melts.

In principle, suitable processing temperatures are above the melting point of the cathode material and below the temperature at which that material has such a vapour pressure that undesirably large losses occur. Preferred temperatures are between 350° and 900° C., for zinc 425° to 890° C., for cadmium 350° to 750° C. Similarly, the processing temperature should not be so high that loss of molten salt electrolyte by evaporation or decomposition becomes substantial.

The current and the supply of metal halide feedstock are so adjusted that complete reduction of Nm in the cathode can take place. Preferably, at least n $F.mol^{-1}$ halide is supplied, n being the valency of the non-metal Nm. The current is, however, restricted to a certain maximum, since net deposition of salt-melt metal in the cathode should preferably be prevented as far as possible. The feedstock should preferably be introduced under homogeneous distribution into the cathode. The easiest way for achieving this is by using feedstocks that are in gaseous form on the moment of their introduction into the cathode material. However, introduction into the cathode of compounds in finely dispersed, solid or liquid form is also included within the scope of this invention. This all results in no Nm, or practically none, in any valency ending up in the salt melt. It is then not necessary to employ a diaphragm to shield the anode, so that no undesired current, feed stock and voltage losses occur, resulting in great technical and economical benefits. Cells having no diaphragm are preferred.

To isolate Nm or compounds/mixtures containing Nm, metal cathode material is withdrawn from the electrolysis cell. In this respect it is remarked that, depending on Nm and cathode metal M used, sometimes a mixture is obtained, sometimes a compound $Nm_pM_q$ is obtained, and sometimes a two phase system is obtained, or complex systems are formed comprising mixtures of the possibilities described hereinbefore.

The invention is elucidated below by a number of experiments.

EXAMPLE I a. 1.5 kg of eutectic LiCl/KCl mixture (59:41 mol) was purified by passing HCl gas through it at above its melting point for 8 hours. The HCl forces the equilibria (a) and (b) shown below to the left, so that an anhydrous, almost oxygen-free melt is obtained.

(a) $Cl^- + H_2O \rightarrow HCl + OH^-$ (b) $2Cl^- + H_2O \rightarrow 2HCl + O^{2-}$ Residual oxygen compounds and metallic impurities are then removed by electrolysis under vacuum at a cell voltage of 2.7 V.

An electrolytic cell of externally heated stainless steel was employed with a molten zinc cathode (90 g) which was placed in a holder of $Al_2O_3$ on the bottom of the cell. A graphite rod served as anode, no diaphragm was used and 250 g salt melt was used as electrolyte. The cell voltage was 5.0 V, the cathode potential was −2.0 V (relative to an Ag/AgCl reference electrode) and the other conditions are given in the Table.

The $SiCl_4$ was injected as a liquid in an argon stream and fed into the cathode. An argon atmosphere was maintained above the salt melt. In all experiments a current of 6 $F.mol^{-1}$ $SiCl_4$ was employed.

The following results were determined by microprobe and chemical analysis of the cooled cathode products and electrolyte.

TABLE

| Cathode | Feedstock | Temp. | Time | Feedrate | Current | Current density | Cathode analysis (% g/g) | | | | Electrolyte analysis (% m/m) | |
|---|---|---|---|---|---|---|---|---|---|---|---|---|
| M | $NmX_n$ | (°C.) | (min) | ($ml \cdot hr^{-1}$) | ($F \cdot mol^{-1}$) | ($A \cdot cm^{-2}$) | M | Nm | Li | K | M | Nm |
| Zn | $BBr_3$ | 800 | 120 | 3.9 | 4.5 | 1 | 98 | 0.051 | 2.5 | <0.3 | 0.08 | <0.005 |
| Zn | $CCl_4$ | 800 | 120 | 3.0 | 6.0 | 1 | >90 | ** | n.d. | n.d. | n.d. | n.d. |
| Zn | $SiCl_4$ | 800 | 78 | 3.6 | 6.0 | 1 | 94 | 0.74 | 1.11 | 0.002 | 0.11 | <0.02 |
| Zn | $GeCl_4$ | 800 | 270 | 3.6 | 6.0 | 1 | 95 | 9.6 | 1.3 | 1.3 | — | 0.64 |
| Ga | $AsCl_3$ | 800 | 240 | 3.1 | 5.0 | 1 | 81 | 14.5 | 2.4 | 0.12 | 0.002 | <0.05 |
| Zn | $SbCl_5$ | 800 | 180 | 3.2 | 7.5 | 1 | 94 | 1.94 | 0.30 | <0.3 | 0.094 | 0.01 |
| Zn | $NaSbF_6$ | 750 | 120 | * | — | 1 | >90 | 1.0 | | n.d. | n.d. | n.d. |
| Zn | $Na_2AsF_6$ | 750 | 120 | * | — | 1 | >90 | 1.8 | | n.d | n.d. | n.d. |
| Zn | $Na_2GeF_6$ | 750 | 120 | * | — | 1 | >90 | 1.4 | | n.d. | n.d. | n.d. |
| Zn | $K_2SiF_6$ | 750 | 120 | * | — | 1 | >90 | 1.2 | | n.d. | n.d. | n.d. |

Electrolyte: LiCl/KCl
* = no continuous feed
** = non-metal Nm proven with XRD
n.d. = not determined

We claim:

1. A process for the production of non-metallic element Nm or a mixture/compound containing Nm from a non-metal halide $NmX_n$ or a complex halide $A_mNmX_o$ by electrolysis in a cell comprisng an anode, a liquid metal cathode comprising one or more metals M and a liquid electrolyte comprising a salt melt of one or more alkali metal halides or alkaline earth metal halides, which comprises the steps of: introducing non-metallic halide $NmX_n$ or complex halide AmNmXo directly into the liquid metal cathode and withdrawing Nm or a mixture/compound containing Nm from the metal cathode material, wherein Nm represents a non-metallic element selected from the group consisting of *3a, 4a, 5a,* and *6a* of the periodic table, X represents halogen, n represents the valency of Nm, A represents an alkali metal and o represents the valency of Nm plus m.

2. A process as claimed in claim 1, in which Nm is a non-metallic element from group *4a* of the periodic system.

3. A process as claimed in claim 1, in which Nm is a non-metallic element from group *5a* of the periodic system.

4. A process as claimed in claim 1, in which Nm is B, C, Si, Ge, As or Sb.

5. A process as claimed in any one of claims 1 to 4, in which X represents fluorine or chlorine.

6. A process as claimed in claim 5, in which A represents K, Li or Na.

7. A process as claimed in claim 5, in which M is Zn, Cd, Al, Sn, Pb, In, Bi or Ga.

8. A process as claimed in claim 7, in which M is Zn, Sn, or Pb.

9. A process as claimed in claim 5, in which non-metallic halide $NmX_n$ is distributed in gaseous form directly into the liquid cathode material.

10. A process as claimed in claim 5, which is carried out in an electrolytic cell having no diaphragm.

11. A process as claimed in any one of claims 1 to 4, in which A represents K, Li or Na.

12. A process as claimed in claim 11, in which M is Zn, Cd, Al, Sn, Pb, In, Bi or Ga.

13. A process as claimed in claim 12, in which M is Zn, Sn or Pb.

14. A process as claimed in claim 11, in which non-metallic halide $NmX_n$ is distributed in gaseous form directly into the liquid cathode material.

15. A process as claimed in claim 11, which is carried out in an electrolytic cell having no diaphragm.

16. A process as claimed in any one of claims 1 to 4, in which M is Zn, Cd, Al, Sn, Pb, In, Bi or Ga.

17. A process as claimed in claim 16, in which M is Zn, Sn or Pb.

18. A process as claimed in claim 16, in which non-metallic halide $NmX_n$ is distributed in gaseous form directly into the liquid cathode material.

19. A process as claimed in claim 16, which is carried out in an electrolytic cell having no diaphragm.

20. A process as claimed in any one of claims 1 to 4, in which non-metallic halide $NmX_n$ is distributed in gaseous form into the liquid cathode material.

21. A process as claimed in claim 20, which is carried out in an electrolytic cell having no diaphragm.

22. A process as claimed in any one of claims 1 to 4, which is carried out in an electrolytic cell having no diaphragm.

* * * * *

UNITED STATES PATENT AND TRADEMARK OFFICE

CERTIFICATE OF CORRECTION

PATENT NO. : 4,874,482

DATED : October 17, 1989

INVENTOR(S) : Honders (II)

It is certified that error appears in the above-identified patent and that said Letters Patent is hereby corrected as shown below:

Column 5, line 25 (claim 4, line 2), "Ge" and "or Sb" should be deleted.

Signed and Sealed this

Sixth Day of August, 1991

*Attest:*

HARRY F. MANBECK, JR.

*Attesting Officer*

*Commissioner of Patents and Trademarks*